US008522369B2

(12) United States Patent
Bay

(10) Patent No.: US 8,522,369 B2
(45) Date of Patent: Sep. 3, 2013

(54) GARMENT PROTECTIVE SYSTEM

(75) Inventor: Marc A. Bay, Farmington Hills, MI (US)

(73) Assignee: Sullivans, Inc., Hanson, MA (US)

( * ) Notice: Subject to any disclaimer, the term of this patent is extended or adjusted under 35 U.S.C. 154(b) by 1545 days.

(21) Appl. No.: 12/101,526

(22) Filed: Apr. 11, 2008

(65) Prior Publication Data

US 2012/0174298 A1 Jul. 12, 2012

(51) Int. Cl.
*A41D 27/26* (2006.01)

(52) U.S. Cl.
USPC ..... 2/461; 2/459; 2/92; 2/DIG. 3

(58) Field of Classification Search
USPC ..... 2/459–465, 455, 2.5, 92, 44, 45, 2/93, 94, 83, 108, 467, 908, DIG. 3
See application file for complete search history.

(56) References Cited

U.S. PATENT DOCUMENTS

| | | | | |
|---|---|---|---|---|
| 1,246,274 | A | 11/1917 | Jelalian | |
| 1,269,019 | A | 6/1918 | Szmyt | |
| 1,360,390 | A | 11/1920 | Gilfillan | |
| 2,010,328 | A | 8/1935 | Siebrandt | |
| 2,079,980 | A | 5/1937 | Anders | |
| 2,114,514 | A | 4/1938 | York | |
| 2,259,560 | A | 10/1941 | Glidden | |
| 2,291,861 | A | 8/1942 | Astrove | |
| 2,477,989 | A | 8/1949 | Maida | |
| 2,607,934 | A * | 8/1952 | Bailhe | 441/107 |
| 3,045,243 | A | 7/1962 | Lash et al. | |
| 3,500,472 | A | 3/1970 | Castellani | |
| 3,691,564 | A | 9/1972 | La Marre et al. | |
| 3,761,962 | A | 10/1973 | Myers | |
| 3,771,169 | A | 11/1973 | Edmund | |
| 3,777,309 | A | 12/1973 | Yeager | |
| 3,878,561 | A | 4/1975 | Winiecki | |
| 3,921,224 | A | 11/1975 | Ingram, III | |
| 3,924,273 | A | 12/1975 | Donovan | |
| 3,969,772 | A | 7/1976 | Pravaz | |
| 4,195,362 | A | 4/1980 | Rolando | |
| 4,513,451 | A | 4/1985 | Brown | |
| 4,554,682 | A | 11/1985 | Hillquist | |
| 4,563,777 | A | 1/1986 | Park | |

(Continued)

FOREIGN PATENT DOCUMENTS

| | | |
|---|---|---|
| FR | 2 413 052 | 7/1979 |
| JP | 59-4722 | 1/1984 |
| JP | 8-284009 | 10/1996 |
| WO | WO 94/00036 | 1/1994 |

OTHER PUBLICATIONS

2000 Motorcycle—Joe Rocket brochure, back page and p. 5 ("Bulldog" jacket), published in 1999.
2001 Kushitani Riding Equipment Collection, 2001,9 pages.

(Continued)

*Primary Examiner* — Gloria Hale
(74) *Attorney, Agent, or Firm* — JWIP & Patent Services, LLC; Jacob G. Weintraub, Esq.

(57) ABSTRACT

A garment protective system includes a protective member and an adjustable member. In another aspect of the present invention, body armor inside a jacket is repositionable due to adjustment of a coupled adjustment strap. A further aspect of the present invention provides a waist belt adjustably coupled to a shoulder area and/or a back area of a jacket.

33 Claims, 7 Drawing Sheets

(56) References Cited

U.S. PATENT DOCUMENTS

| | | | | |
|---|---|---|---|---|
| 4,608,715 | A | 9/1986 | Miller et al. | |
| 4,722,099 | A | 2/1988 | Kratz | |
| D308,435 | S | 6/1990 | Kushitani | |
| 4,996,723 | A | 3/1991 | Huhn et al. | |
| 5,105,477 | A | 4/1992 | Golde | |
| 5,115,516 | A | 5/1992 | Golde | |
| 5,319,806 | A * | 6/1994 | Hermann et al. | 2/461 |
| 5,450,627 | A * | 9/1995 | Grilliot et al. | 2/81 |
| 5,507,042 | A | 4/1996 | van der Slessen | |
| 5,530,966 | A * | 7/1996 | West | 2/462 |
| 5,592,691 | A | 1/1997 | Ronald | |
| 5,611,084 | A * | 3/1997 | Garry et al. | 2/93 |
| 5,704,064 | A | 1/1998 | van der Sleesen | |
| 5,752,277 | A | 5/1998 | van der Sleesen | |
| 5,774,891 | A | 7/1998 | Boyer | |
| 5,845,336 | A | 12/1998 | Golde | |
| 5,850,634 | A | 12/1998 | Toombs | |
| 5,884,332 | A | 3/1999 | Snedeker | |
| 6,070,274 | A | 6/2000 | van der Sleesen | |
| 6,085,353 | A | 7/2000 | van der Sleesen | |
| 6,260,196 | B1 | 7/2001 | van der Sleesen | |
| 6,263,510 | B1 | 7/2001 | Bay et al. | |
| 6,339,843 | B1 | 1/2002 | Grilliot et al. | |
| 6,405,377 | B1 | 6/2002 | Davis | |
| 6,421,834 | B2 | 7/2002 | Kester | |
| 6,675,389 | B1 | 1/2004 | Kublick | |
| 6,681,399 | B1 * | 1/2004 | Kerr | 2/2.5 |
| 6,684,408 | B2 | 2/2004 | Rindle et al. | |
| 6,792,621 | B2 | 9/2004 | Braun | |
| D498,037 | S | 11/2004 | Bay | |
| 6,851,128 | B1 | 2/2005 | Parrotte | |
| 6,854,130 | B2 | 2/2005 | van der Sleesen | |
| 6,868,557 | B1 | 3/2005 | van der Sleesen | |
| 6,968,573 | B2 | 11/2005 | Silver | |
| 7,000,255 | B1 * | 2/2006 | Baacke | 2/94 |
| 7,062,789 | B1 | 6/2006 | Blackwell | |
| 7,284,282 | B2 * | 10/2007 | Bay | 2/93 |
| D555,878 | S | 11/2007 | Bay | |
| 2002/0130150 | A1 | 9/2002 | Stanley | |
| 2003/0024028 | A1 | 2/2003 | van der Sleesen | |
| 2003/0126667 | A1 | 7/2003 | Braun et al. | |
| 2003/0140399 | A1 | 7/2003 | Golde | |
| 2003/0140404 | A1 | 7/2003 | Golde | |
| 2004/0055069 | A1 | 3/2004 | Clarke Fayle et al. | |
| 2004/0158910 | A1 | 8/2004 | Bay | |
| 2004/0199976 | A1 | 10/2004 | Hunt | |
| 2004/0237168 | A1 | 12/2004 | Braun | |
| 2005/0072825 | A1 | 4/2005 | Barr | |
| 2006/0176660 | A1 | 8/2006 | Amiri | |
| 2007/0083973 | A1 | 4/2007 | Garniewicz | |
| 2008/0040832 | A1 | 2/2008 | Bay | |
| 2008/0060112 | A1 | 3/2008 | Driehorst | |
| 2009/0320188 | A1 * | 12/2009 | Johnson et al. | 2/455 |
| 2010/0306907 | A1 * | 12/2010 | Fiegener et al. | 2/461 |
| 2011/0154561 | A1 * | 6/2011 | Singhal | 2/455 |

OTHER PUBLICATIONS

Fieldsheer Mach 1, Mach 2, Sonic Air, Titanium Air, Highland Suit, Highland 2, Kiri, Manx Pro, Spiga, Thistle, XPack Tech, Cabrio, Latrak jackets; http://store.fieldsheer.com (Feb. 8, 2003).

"Joe Rocket" Catalog, Spring 2002, (published 2002), Cover page and pp. 4-5, 13, 32 and 35.

"Accessories Collection", 4 pages, www.TeknicGear.com/main_pages/accessories/RL.htm, (Apr. 26, 2000).

* cited by examiner

GARMENT PROTECTIVE SYSTEM

BACKGROUND AND SUMMARY OF THE INVENTION

The present invention relates generally to a garment protective system and more particularly to a jacket including a protective member and an adjustable member.

It is known to provide motorcycle jackets with protective body armor. Exemplary motorcycle jackets are shown in: U.S. Patent Application No. 2008/0040832 entitled "Ventilated Garment" invented by Bay and published on Feb. 21, 2008; U.S. Pat. No. 7,284,282 entitled "Hybrid Ventilated Garment" which issued to Bay on Oct. 23, 2007; and U.S. Pat. No. 6,263,510 entitled "Ventilating Garment" which issued to Bay et al. on Jul. 24, 2001; all of which are incorporated by reference herein. While these ventilated garments are significant improvements in the industry, additional opportunities to improve user comfort and protection exists.

In accordance with the present invention, a garment protective system includes a protective member and an adjustable member. In another aspect of the present invention, body armor inside a jacket is repositionable due to adjustment of a coupled adjustment strap. A further aspect of the present invention provides a waist belt adjustably coupled to a shoulder area and/or a back area of a jacket. A method of manufacturing a garment is also provided.

The garment of the present invention is advantageous over prior devices in that the present invention garment allows for adjustable repositioning of the body armor and/or protective pads within a jacket. This system advantageously improves wearer comfort and improves protective placement of the armor over the desired, targeted areas of the user. Since the wearers' sizes vary even within a given jacket size, such adjustability of the body armor is advantageous. Furthermore, user positioning on a racing-type motorcycle versus a cruiser-type motorcycle, for example, will often necessitate different body armor positioning within a jacket to maximize comfort and protection. Moreover, user preferences also vary. The adjustable strap system of the present application secures a predetermined armor pad position set by the user while also snugging the protective armor pads to the user's body. This is contrasted to traditional garments which only secure pads to the jacket but not the user, resulting in a loose fitting jacket and, thus, loose fitting armor. It is further advantageous to interchange removable armor within the system. Additional advantages and features of the present invention will become apparent from the following description and appended claims, taken in conjunction with the accompanying drawings.

DETAILED DESCRIPTION OF THE PREFERRED EMBODIMENT

Figure 1:
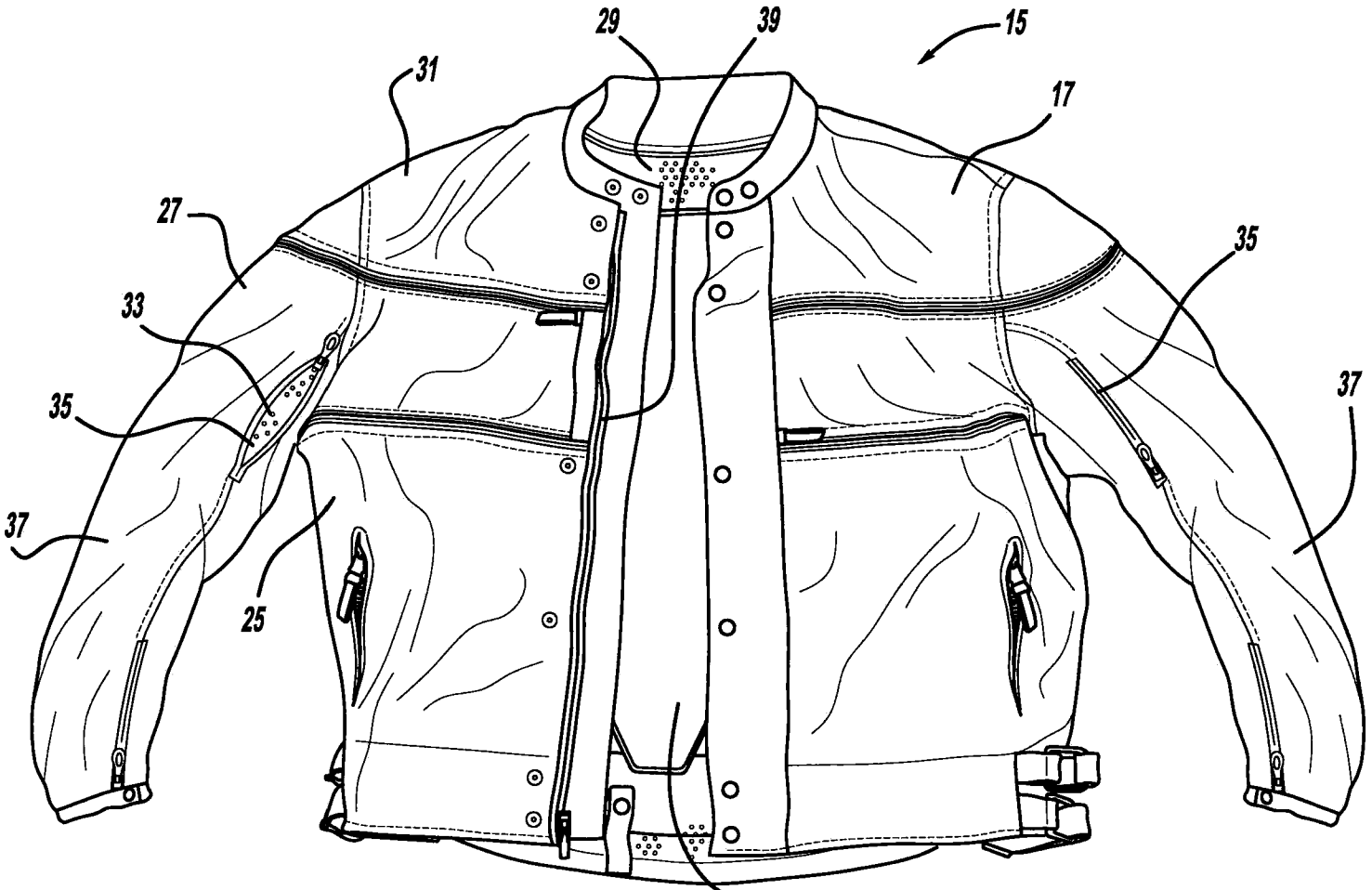
FIG. 1 is a front elevational view showing the preferred embodiment of a garment protective system of the present invention.
Figure 2:
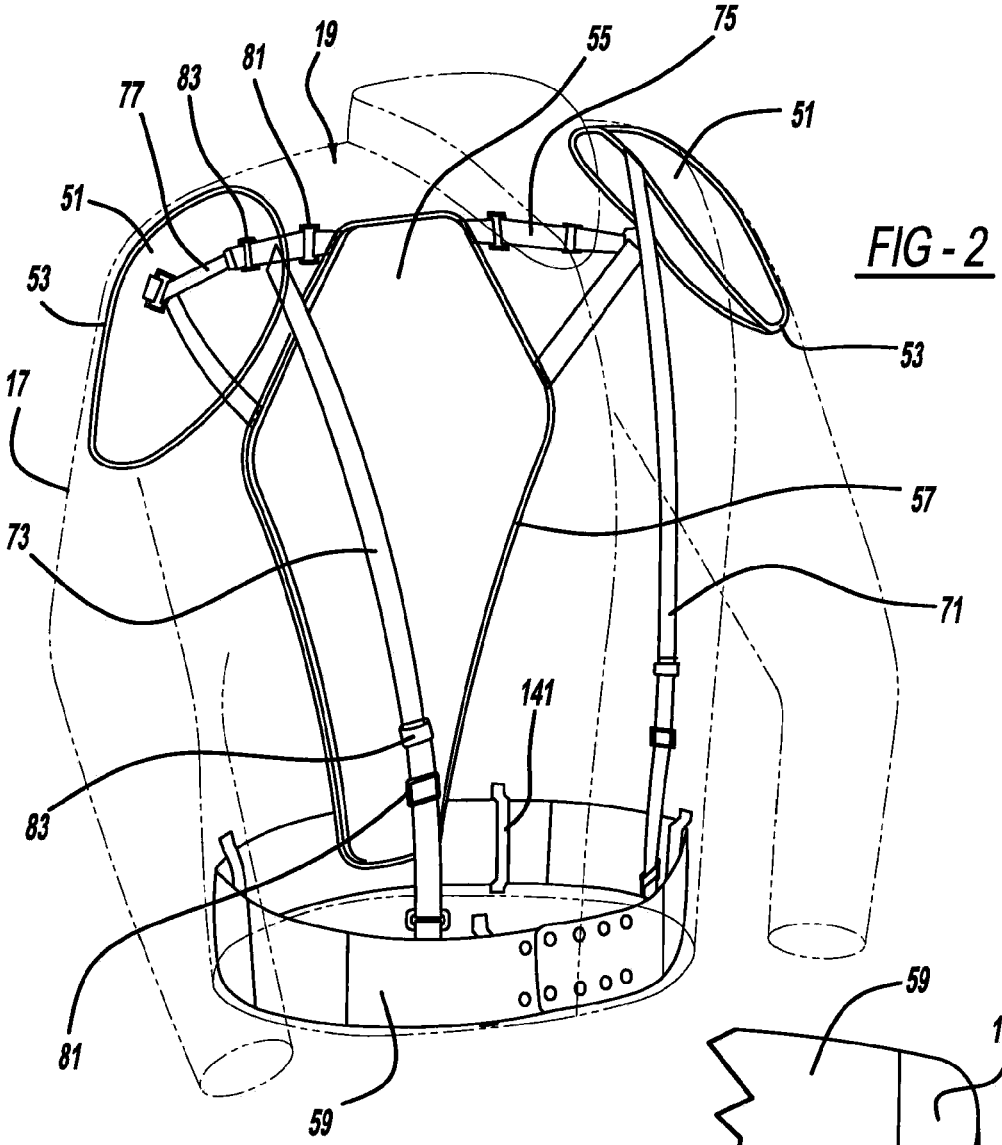
FIG. 2 is a front perspective view showing the garment protective system.
Figure 6:
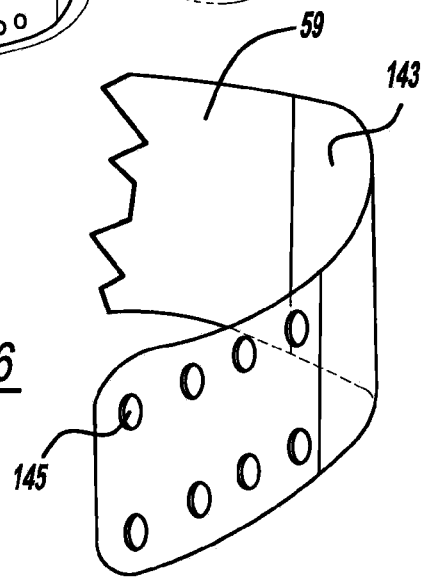
FIG. 6 is a fragmentary perspective view showing a portion of a waist belt employed in the garment protective system.
Figure 3:
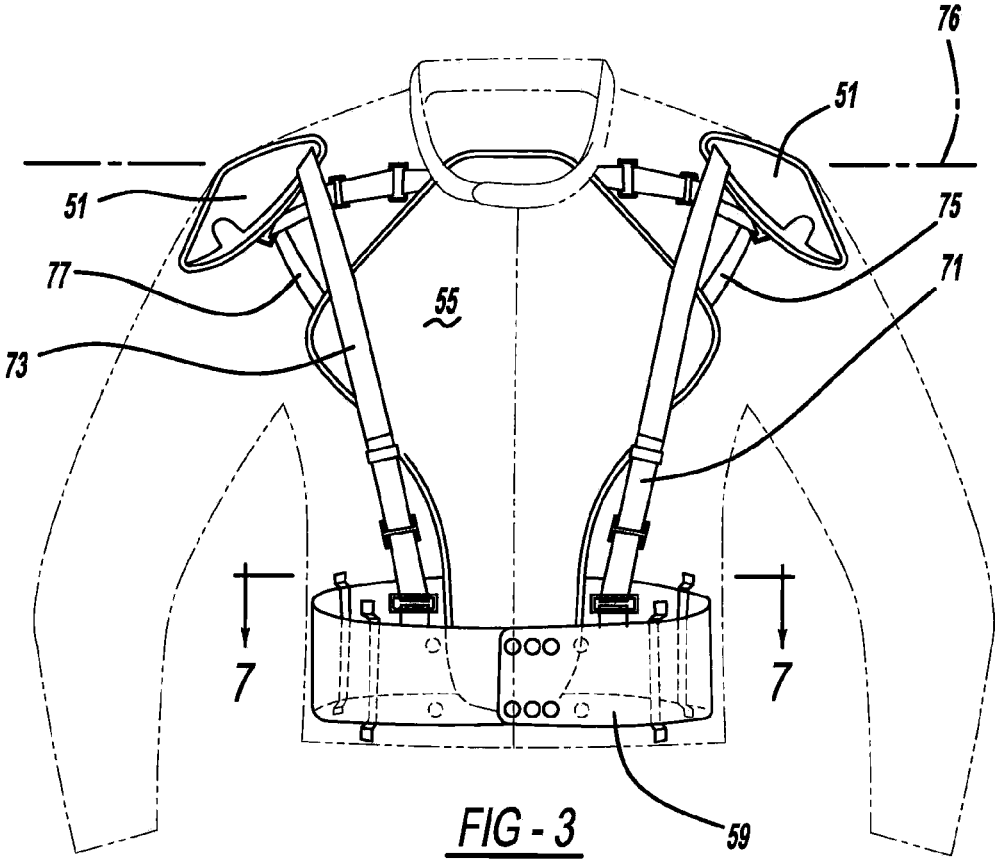
FIG. 3 is a front elevational view showing the garment protective system.

Referring to FIGS. 1 and 2, the preferred embodiment of a garment protective system 15 includes a garment, preferably a jacket 17, and an adjustable protective system 19. It should be appreciated that the terms garment and jacket include a stand-alone jacket, such as that shown, in addition to a combined jacket/pant racing suit, or any other article of clothing for covering at least a torso of a wearer. Garment protective system 15 is preferably worn by a person riding a motorsport vehicle, such as a motorcycle or other motorized vehicle such as all-terrain vehicle or snowmobile. Alternately, garment protective system 15 is used for skiing, snowboarding or other sporting endeavors, although various advantages of the present invention may not be fully used.

Jacket 17 includes two major portions, a body 25 and a removable shell or cover 27. Body 25 has a mesh inner liner 29, an outer wind resistant layer 31 and an outer mesh material 33. The outer mesh material 33 is only exposed when shell 27 is optionally removed during warm weather use. Air vents 35 are provided on sleeves 37 and a back torso portion to allow air through the jacket when the vents are unzipped even if a vertical and main zipper closure 39 is in a closed condition. Outer layer 31 may be a textile or leather material.

FIGS. 2-12 illustrates protective system 19 in greater detail. The protective system includes a pair of body armor shoulder pads 51 and their associated shoulder pockets 53, a body armor spine pad 55 and its associated back pocket 57, a waist belt 59, and adjustable straps. A vertically (as viewed in a user standing orientation such as that shown in FIGS. 2-4) elongated strap 71 has a lower end sewn to an inside of waist belt 59 and an upper end sewn to an inside surface of shoulder pocket 53. Similarly, another vertically extending strap 73 is sewn between waist belt 59 and the opposite shoulder pocket 53. A transversely elongated strap 75 spans between shoulder pocket 53 and back pocket 57, essentially adjacent to a transverse line 76, with each end sewn thereto. Similarly, an oppositely extending strap 77 extends from the other side of back pocket 57 to the opposite shoulder pocket 53. A slide ring 81 and a slide adjuster 83 provide for length adjustment of adjustable straps 71, 73, 75 and 77. The slide adjuster has a generally polygonal B-like shape. A tab 91 is sewn to each shoulder pocket 53 and a slide ring 93 is secured to a looped end of tab 91. This allows for strap 75 to slide through ring 93 when being adjusted. A similar tab and ring arrangement are employed with the opposite strap 77 and shoulder pocket 53.

These straps, slide rings and slide adjusters advantageously allow the wearer to predetermine the pad spacing within the jacket, which is thereafter maintained in the desired set position during jacket use and for each subsequent jacket use, until the spacing is manually changed by the user. The adjustment strap construction preferably described and shown herein allows at least the shoulder armor, back armor and belt to be interconnected and work as an interdependent unit, while also somewhat bunching up the jacket liner to correspond to the armor and belt positioning. When the jacket is taken off and put back on by the user, the relative system positioning and adjustments will remain the same each time, until intentionally readjusted by the user.

Figure 9:
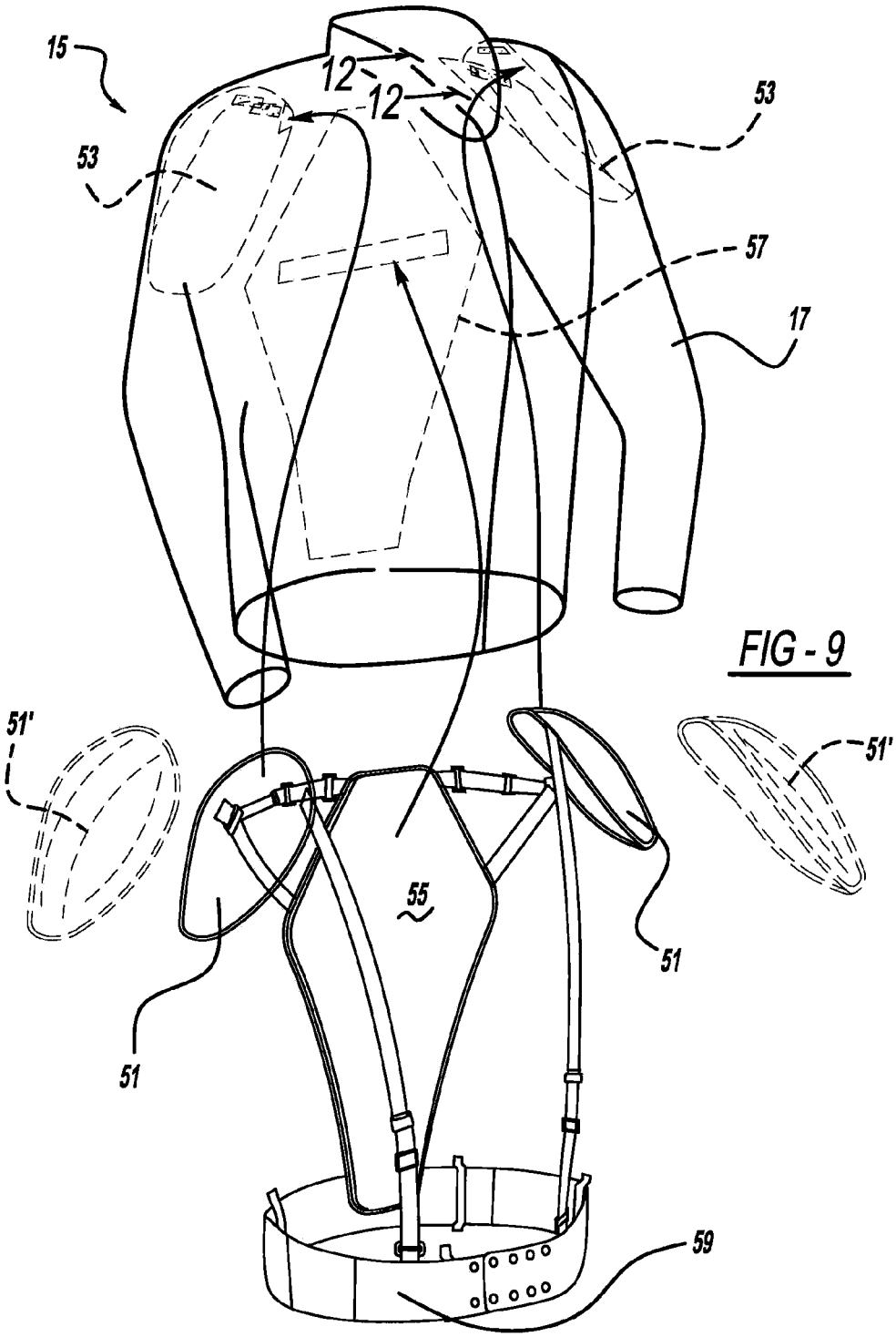
FIG. 9 is an exploded, front perspective view, showing the garment protective system.
Figure 11:
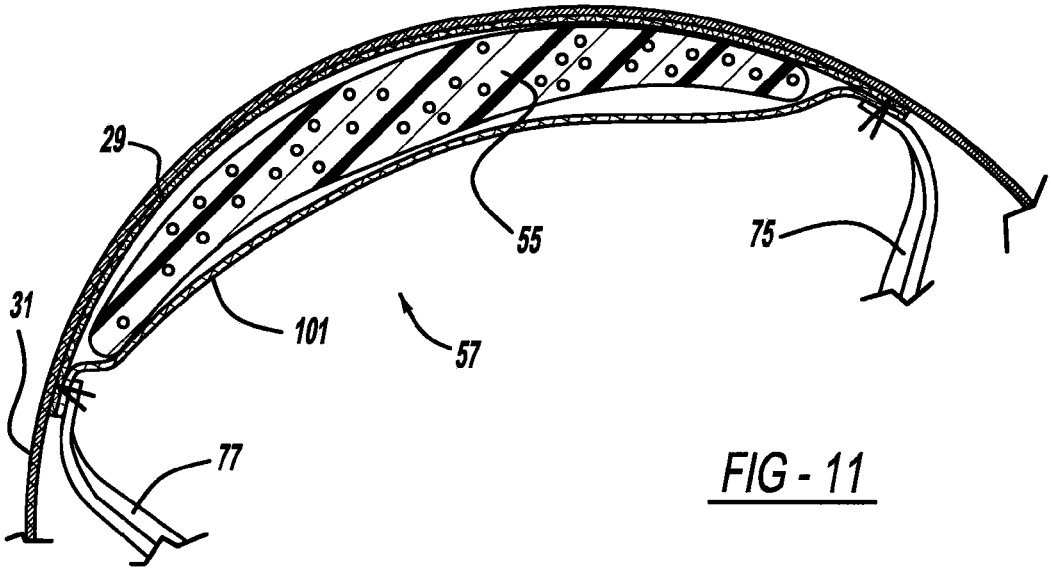
FIG. 11 is a cross sectional view, taken along line 11-11 of FIG. 10, showing the garment protective system.
Figure 12:
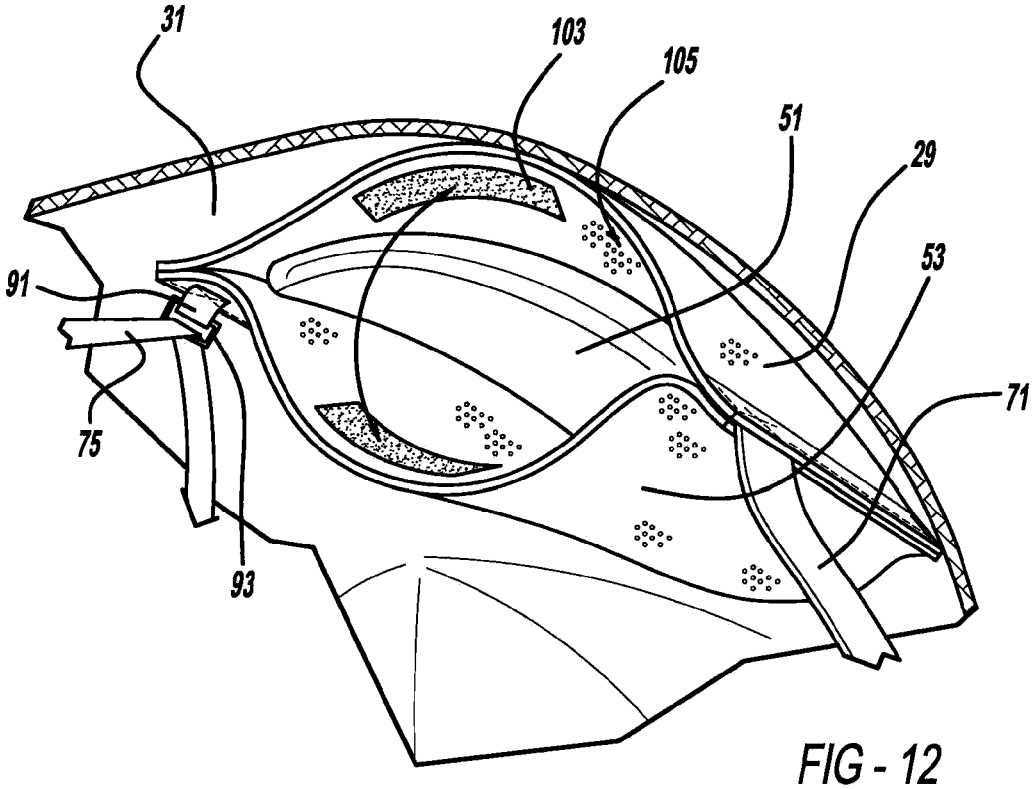
FIG. 12 is a fragmentary perspective view, taken in the direction of arrows 12-12 of FIG. 9, showing a shoulder pad and pocket employed in the garment protective system, in an open condition.

Each pocket 53 and 57 is defined by one or more inner pocket layers 101 peripherally sewn to inner liner 29 of the jacket. A Velcro® hook and loop type fastener 103 allow for opening and closing of an opening 105 through which the respective shoulder pads 51 and spine pad 55 are inserted and removed. This advantageously allows for easy replacement of the body armor with alternately configured body armor of different characteristics, such as having different sizes or different materials depending on user preference, body sizes and motorcycle uses (for example, racing versus casual long distance riding). By way of example, spine pad 55 of FIG. 11 is preferably a dual density, EVA back pad with the outside portion more rigid than an inside portion. Nevertheless a replacement spine pad or shoulder pad may consist of a single density polyurethane foam pad, a dual density polyethylene foam pad, or the like. As another example, FIG. 9 shows the original three-dimensionally molded, dual density shoulder pads 51, however, a replacement shoulder pad 51' may include a substantially rigid, injection molded and polymeric outer shell, a non-preformed die cut and fibrous pad, a larger sized foam pad having a greater inside radius, or the like. Such interchangeability further enhances the adjustability and customized nature of the garment protective system. Removal of the pads also allows for easy washing of the pads and/or jacket.

FIGS. 2 and 6-8 show waist belt 59 attached to an internal surface of outer jacket material 31 by way of multiple vertically elongated belt loops 141. Ends of each belt loop are sewn to jacket outer 31 or alternately to the inner liner of the jacket, while waist belt 59 is allowed to freely slide within loops 141. Waist belt 59 further has a pair of elastic segments 143 and multiple spaced apart sets of snaps 145 to allow for user adjustment of the belt. It is alternately envisioned that hook and loop type fasteners or an adjustable buckle can be substituted in place of snaps 145.

Figure 7:
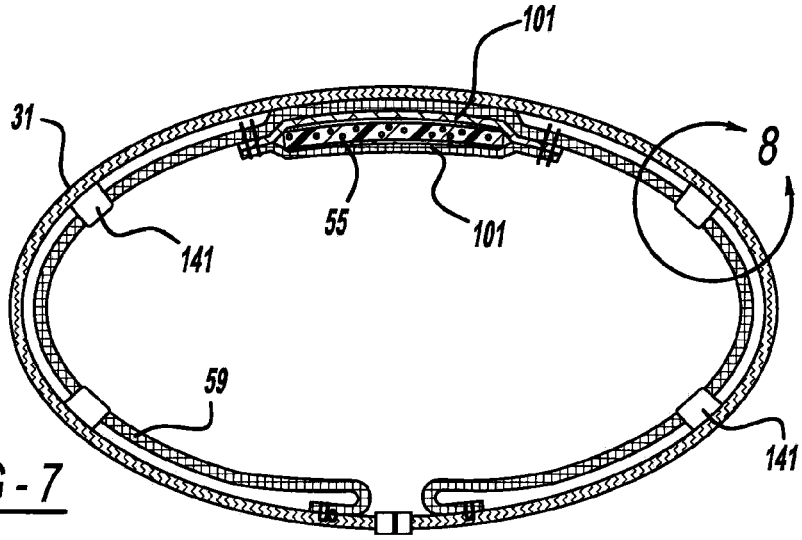
FIG. 7 is a cross sectional view, taken along line 7-7 of FIG. 3, showing the garment protective system.
Figure 4:
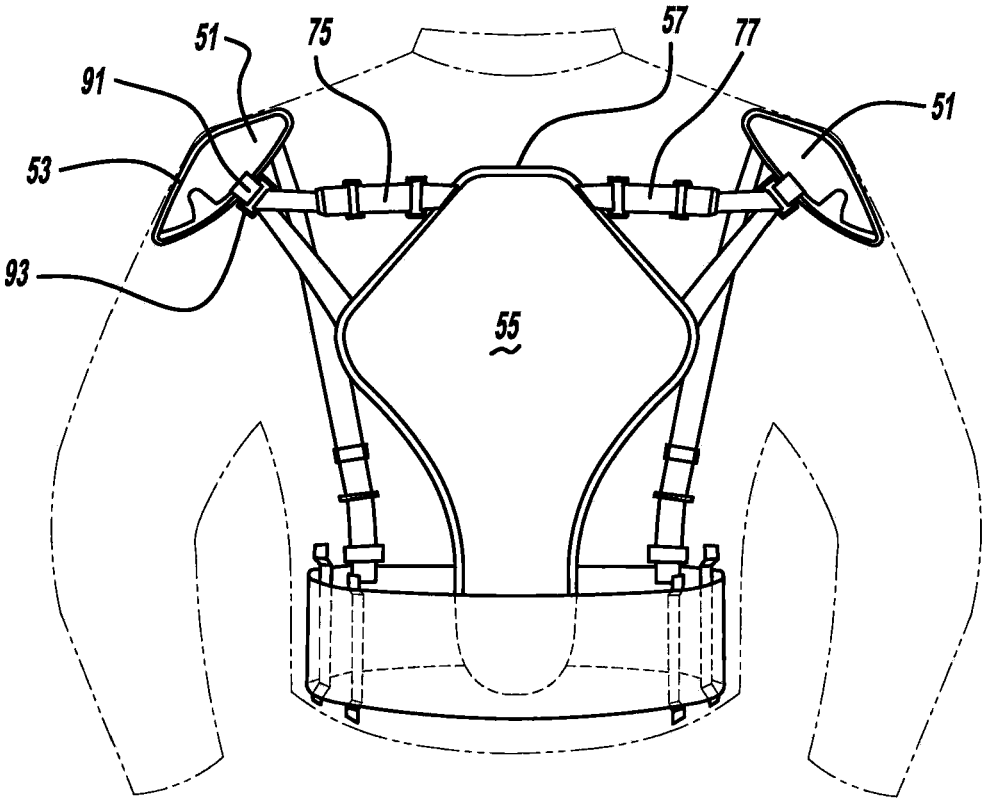
FIG. 4 is a rear elevational view showing the garment protective system.
Figure 8:
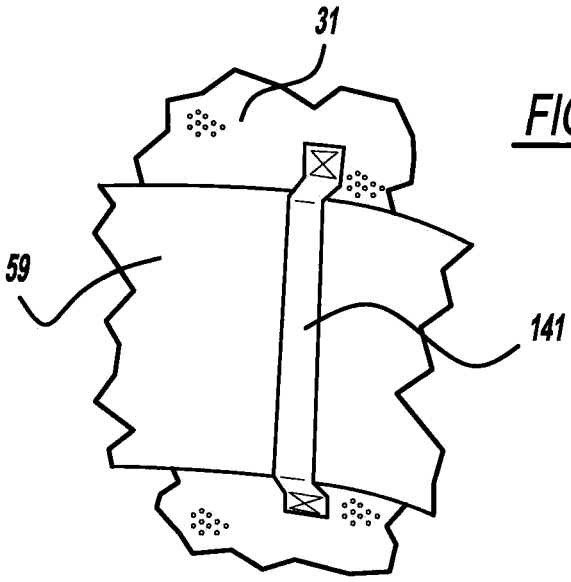
FIG. 8 is a fragmentary perspective view, taken within circle 8 of FIG. 7, showing a portion of the garment protective system.
Figure 5:
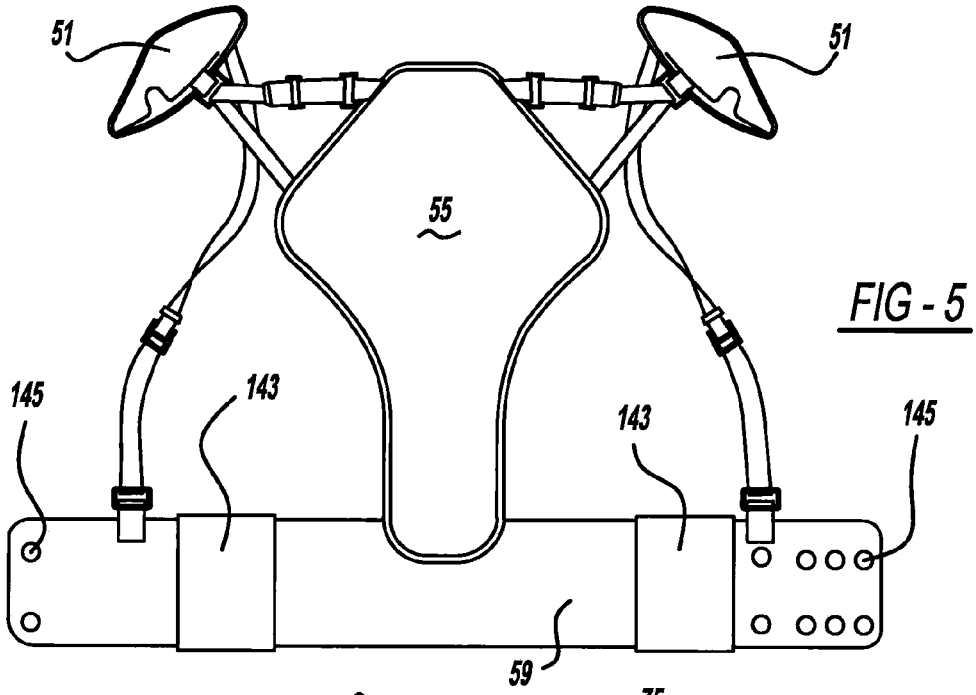
FIG. 5 is a rear elevational view showing the garment protective system in an open position with a jacket removed.
Figure 10:
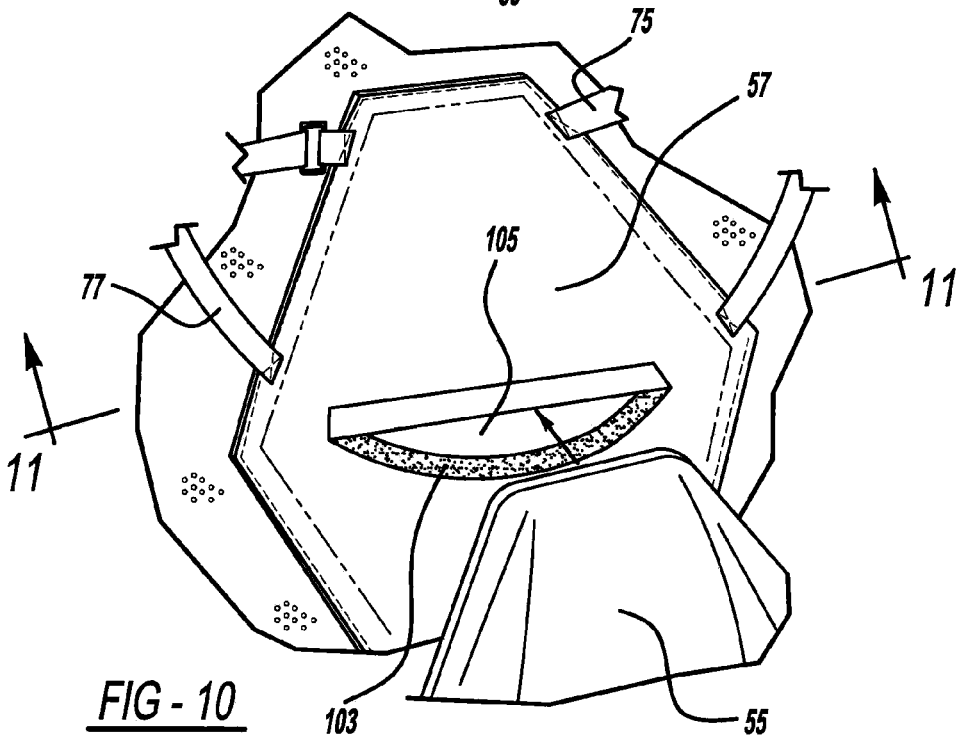
FIG. 10 is a fragmentary and partially exploded, perspective view showing a spine pad and pocket employed in the garment protective system.

FIG. 7 illustrates two layers 101 defining pocket 57 which secure spine pad 55. Layers 101 of the back pocket are peripherally sewn to waist belt 59 adjacent a lower section of spine pad 55. Alternately, however, an adjustable strap can interconnect the bottom of the back pocket to the waist belt.

The body armor pockets are preferably made from an open nylon mesh material such as the type used for the inner jacket liner. Furthermore, the adjustable straps are preferably made from a non-stretchable polypropylene webbing to prevent body armor movement after the adjustment is set by the user. The slide adjusters and rings are preferably made from a rigid and molded polymeric material.

While various constructions of the garment protective system have been disclosed, it should be appreciated that other modifications may be made which fall within the scope of the present invention. For example, other body armor and/or pad members may be employed with an adjustable positioning arrangement such as that disclosed. Furthermore, the garment protective system can be employed with or without a spine pad and/or a waist belt, although, many of the benefits of the present invention system may not be achieved. Moreover, it is alternately envisioned that other adjustment members and/or adjustable strap geometries can be provided as long as the advantageous functional features of the presently disclosed garment protective system are employed, however, such other configurations and geometries may not fully utilize the benefits and advantages disclosed herein.

Various materials have been disclosed in an exemplary fashion, but other materials may of course be employed, although some of the advantages of the present invention may not be realized. It is intended by the following claims to cover these and any other departures from the disclosed embodiment which fall within the true spirit of the invention.

The invention claimed is:

1. A garment system comprising: a jacket; a body armor member coupled to the jacket; and an adjustable strap operably and adjustably positioning the body armor member relative to at least a portion of the jacket in a predetermined position set by the user, wherein the body armor member is a three-dimensionally preformed shoulder pad located inside of the jacket.

2. The garment system of claim 1 further comprising a second body armor member coupled to the jacket, the adjustable strap spanning between both of the body armor members.

3. The garment system of claim 1 further comprising a belt coupled to a waist portion of the jacket, the adjustable strap spanning between the body armor member and the belt.

4. The garment system of claim 1 wherein the body armor member is a spine pad located inside the jacket, the spine pad being located within a pocket having at least three contact points to an adjustment system which includes the strap.

5. The garment system of claim 1 wherein the jacket is a motorcycle jacket including multiple vents which are operable to allow air flow into the jacket even when a vertical and main front closure of the jacket is in its closed orientation, and the adjustable strap spans between shoulder areas of the jacket.

6. The garment system of claim 1 further comprising an openable pocket attached inside the jacket, the pocket including an opening allowing for insertion and removal of the body armor member, the strap being connected to the pocket in order to adjust the positioning of the pocket and body armor member contained therein relative to the remainder of the jacket.

7. A garment system comprising: a jacket; multiple protective pads coupled to the jacket; and an adjustable member coupled to the pads, wherein the pads comprise at least two three-dimensionally preformed shoulder pads located inside of the jacket.

8. The garment system of claim 7 further comprising a third protective pad coupled to the jacket, and a second adjustable member spanning between a first set of the pads and the third pad.

9. The garment system of claim 7 further comprising an adjustable belt coupled inside a waist portion of the jacket, a second adjustable member spanning between at least one of the pads and the belt.

10. The garment system of claim 7 wherein at least one of the pads is a spine pad located inside the jacket.

11. The garment system of claim 7 wherein the jacket is a motorcycle jacket including multiple vents which are operable to allow air flow into the jacket even when a vertical and main front closure of the jacket is in its closed orientation.

12. The garment system of claim 7 further comprising an openable pocket attached to the jacket, the pocket including an opening allowing for insertion and removal of an associated one of the pads, the pocket coupling the adjustable member to the associated one of the pads in order to adjust the positioning of the pocket and pad contained therein relative to the remainder of the jacket.

13. A garment system comprising: a jacket; an adjustable belt located at a waist of the jacket; and an adjustable member spanning between the belt and a shoulder area of the jacket, and further comprising a protective pad located at the shoulder area of the jacket, wherein the adjustable member operably varies the orientation of the pad relative to the belt through length adjustment of the adjustable member.

14. The garment system of claim 13 further comprising a second pad coupled to the jacket, and a second adjustable member spanning between the pads.

15. The garment system of claim 13 further comprising a second adjustable member spanning between the belt and a second and opposite shoulder area of the jacket, ends of the adjustable members opposite the belt being permanently attached to the jacket.

16. The garment system of claim 13 further comprising a shoulder pad located at the shoulder area of the jacket.

17. The garment system of claim 13 further comprising a spine pad located inside the jacket, and a second adjustable member coupling a pocket holding the spine pad to the shoulder area.

18. The garment system of claim 13 wherein the jacket is a motorcycle jacket including multiple vents which are operable to allow air flow into the jacket even when a vertical and main front closure of the jacket is in its closed orientation.

19. The garment system of claim 13 further comprising a pocket attached inside the jacket, the pocket including an opening allowing for insertion and removal of a body armor member, the adjustable member being connected to the pocket in order to adjust the positioning of the pocket and armor member contained therein relative to the waist.

20. A garment system comprising: a motorcycle garment; and an adjustable member spanning between a back area of the garment and a shoulder area of the garment; the distance between the back area and shoulder area being varied by adjustment of the adjustable member.

21. The garment system of claim 20 further comprising a first removable protective shoulder member located at the shoulder area and a protective back member located at the back area, the adjustable member being a substantially inelastic and elongated strap with an adjuster moveable between various desired set positions.

22. The garment system of claim 21 further comprising a second removable protective shoulder member coupled to the garment, a second adjustable member spanning inside the garment between the shoulder members.

23. The garment system of claim 20 further comprising a belt coupled to a waist portion of the garment, a second adjustable member spanning between the shoulder area and the belt.

24. The garment system of claim 20 wherein the garment including multiple vents which are operable to allow air flow into the garment even when a vertical and main front closure of the garment is in its closed orientation.

25. The garment system of claim 20 further comprising a back pocket and a shoulder pocket attached inside the garment, the pockets including an opening allowing for insertion and removal of body armor, the adjustable member being connected to the pockets in order to adjust the positioning of the pockets and body armor contained therein.

26. A garment system comprising: a first shoulder protective member; a waist belt; a second back protective member having an elongated configuration substantially from a transverse line through the shoulder member substantially to the waist belt; a first adjustable strap spanning between the belt and at least one of the members; and a second adjustable strap spanning between the protective members; adjustment of the straps operably varying relative positioning of the protective members.

27. The garment system of claim 26 further comprising a jacket including an outer layer and an inner liner, the protective members being attached to the inner liner by pockets, and the waist belt being coupled to the jacket.

28. The garment system of claim 26 further comprising a third protective member coupled to the jacket, and a third adjustable straps connected to the third protective member.

29. The garment system of claim 26 further comprising a replacement protective member interchangeably replacing one of the other protective members, the replacement protective member having a different characteristic than the other protective members.

30. The garment system of claim 26 wherein at least one of the protective members includes three-dimensionally shaped foam.

31. The garment system of claim 26 wherein the back productive member is a spine pad located inside the jacket and attached to the waist belt, and at least one of the adjustable members has an adjuster moveable between various desired positions.

32. The garment system of claim 26 further comprising a motorcycle jacket including multiple vents which are operable to allow air flow into the jacket even when a vertical and main front closure of the jacket is in its closed orientation, the waist belt and protective members being coupled to the jacket.

33. A method of manufacturing a jacket, the method comprising: (a) making a jacket with an outer layer and an inner liner; (b) attaching pockets to the jacket; (c) inserting protective pads in the pockets; (d) attaching a substantially inelastic adjustable member to the pockets; and (e) setting a length of the adjustable member to one of various possible set positions, and further comprising: creating air flow vents in the outer layer of the jacket; and forming at least one of the protective pads in a three dimensional shape prior to attachment to the jacket.

* * * * *